US007663859B1

(12) United States Patent
Patel

(10) Patent No.: US 7,663,859 B1
(45) Date of Patent: Feb. 16, 2010

(54) ELECTROSTATIC FOOTWEAR

(76) Inventor: Manoj Patel, 901 Crescent Dr., Highland Village, TX (US) 75077

( * ) Notice: Subject to any disclaimer, the term of this patent is extended or adjusted under 35 U.S.C. 154(b) by 115 days.

(21) Appl. No.: 11/735,610

(22) Filed: Apr. 16, 2007

Related U.S. Application Data

(60) Provisional application No. 60/745,603, filed on Apr. 25, 2006.

(51) Int. Cl.
*H05F 3/00* (2006.01)
*G03G 15/02* (2006.01)

(52) U.S. Cl. ..... 361/225; 361/223; 361/224

(58) Field of Classification Search ..... 361/223, 361/224

See application file for complete search history.

(56) References Cited

U.S. PATENT DOCUMENTS 5,644,813 A 7/1997 Puskas
5,697,106 A * 12/1997 Baker et al. ..... 2/239
5,763,337 A * 6/1998 Montgomery ..... 442/398
6,430,771 B2 * 8/2002 Ahern ..... 15/118
6,625,903 B2 * 9/2003 Swango et al. ..... 36/7.1 R
7,137,169 B2 * 11/2006 Murphy et al. ..... 15/320

* cited by examiner

*Primary Examiner*—Albert W Paladini
*Assistant Examiner*—Dharti H Patel
(74) *Attorney, Agent, or Firm*—Michael I Kroll

(57) ABSTRACT

Electrostatic footwear in the form of a cover with a sole and an upper having an opening to receive the foot or shoe of a user. The opening may be provided with elastic or an elastic cuff for retention about the user. The cover may be worn over the foot or the shoe of a user. The cover has an excess electrical charge to attract particulate matter including but not limited to dust, dirt, pollen, and dander. The electrostatic charge causes the particulate matter to be drawn and held thereon as the user moves about. The sole may include anti-skid material over a limited portion thereof to prevent the user from sliding or slipping.

13 Claims, 14 Drawing Sheets

ELECTROSTATIC FOOTWEAR

RELATED APPLICATIONS

This application is subject to U.S. provisional application Ser. No. 60/745,603 filed 25 Apr. 2006.

BACKGROUND OF THE INVENTION

1. Field of the Invention

The present invention relates generally to footwear and, more specifically, to a shoe/foot electrostatic-slipper covering that when worn by a user within a structure having a floor electrostatically attracts particles from the floor to the slipper (s) and therein reduce the amount of airborne particles that can irritate allergies.

Furthermore, the types of particles that would be attracted are not easily swept up and are more inclined to become airborne such as lint, pollen and dust. Therefore, the present invention provides means for reducing the amount of airborne particles on a structure's floor by simply wearing the foot covering of the present invention that will electrostatically bind floor particles thereto.

The invention is in the form of a cover for a shoe or a foot which, when worn indoors on a smooth floor surface, will clean the floor by attracting lint, dust, hair and small debris.

The invention is a shoe covering comprised of a body made of any material that is capable of being appropriately formed to surround a shoe or foot with preference to non-woven fabric. The sole of the shoe cover will be made of material with properties, which will enable it to pick up dust and other small debris. An example of such material would be an electrostatic charged fabric or microfiber. The shoe covering can be used indoors so that when the user walks into a house or building, will slip it on by inserting the foot into the elastic opening at the top of the shoe cover. Once the shoes or feet are covered by the shoe cover, the wearer can go about normal indoor activities and while walking around the house or building, the shoe cover acts as a floor cleaning instrument. This enables the user to keep the floor free of dust and small debris without having to take any extra time to do it.

The invention can be used indoors where cleanliness is desired with the purpose of keeping tile, wood, laminate and vinyl floors free of dust and small dirt debris without having to take any extra time to do it. The shoe covering could also be used for the dual purpose of keeping floors (including carpeted floors) from getting dirty from soiled shoes. The shoe covering is made of non-woven porous materials such as spunbound polypropylene or non-woven laminates, such as spunbound/meltblown/spunbound laminates. It includes an opening that enable the shoe cover to be slipped over the foot or shoes of the wearer. The opening can optionally include a stretchable or resilient material such as rubber or elastomer to maintain the shoe cover on the foot of the wearer. The bottom (sole) of the shoe cover is made of any material that is capable of attracting dust and small debris, but preferably, electrostatic charged fabric or microfiber. The sole also has a print or sprayed on traction adhesive, making the shoe covers slip resistant.

The invention is a shoe/foot cover comprising a body that configures to surround the shoe or foot of the wearer with a bottom portion of the body designed to contact the ground when the cover is worn. The shoe cover is made of non-woven porous material such as spunbond polypropylene or non-woven laminates, such as spunbond, meltblown or spunbond laminates. It includes an opening that enables the shoe cover to be slipped over the foot or shoes of the wearer. The opening can optionally include a stretchable or resilient material such as rubber or elastomer to maintain the shoe cover on the foot of the wearer. The bottom (sole) of the shoe cover is made of a material such as, electrostatic charged fabric or microfiber, with properties for attracting dust or small dirt particles.

Furthermore, the footwear has particular application in research and manufacturing facilities where cleanroom technology is used to control environmental contaminents, such as lint, dust, dirt and pollen.

2. Description of the Prior Art

There are other cleaning devices worn over shoes. Typical of these is U.S. Pat. No. 5,644,813 issued to Puskas on Jul. 8, 1997.

U.S. Pat. No. 5,644,813

Inventor: Paula Puskas

Issued: Jul. 8, 1997

A disposable overshoe mop (10) comprising a structure (12), for covering a shoe (14) or foot worn by a person (16), so as to protect the shoe (14) or foot from water and dirt. A component (18) is affixed to the bottom of the covering structure (12), for cleaning a floor (20).

While this type of device may be suitable for the purposes for which they were designed, they would not be as suitable for the purposes of the present invention, as hereinafter described.

SUMMARY OF THE PRESENT INVENTION

A primary object of the present invention is to provide means for cleaning a floor using an electrostatically charged article.

Another object of the present invention is to provide footwear made of electrostatic cloth.

Yet another object of the present invention is to provide footwear that can be worn with or without shoes.

Still yet another object of the present invention is to provide footwear that can be worn by a user with or without shoes comprised of a material having been imbued with a negative electric charge so that when the user dons the footwear and walks across a floor, particulate matter, dust, dirt, dander, pollen, etc will be electrostatically drawn to the footwear and held thereto by said electrostatic charge.

Another object of the present invention is to provide footwear comprised of non-woven material, such as spunbound polypropylene, non-woven laminates, such as spunbound/meltblown/spunbound laminates and preferably a composition of polypropylene and 5%-25% polyimide.

Yet another object of the present invention is to provide the footwear with an opening or aperture having an elastomeric member along the rim to retain placement of said footwear during use.

Still yet another object of the present invention is to provide footwear of electrostatic cloth having anti-slip agent applied to the bottom of said footwear.

Another object of the present invention is to provide said footwear with anti-slip agents comprising structure applied to the bottom of the footwear in minimalistic fashion so as not to defeat the purpose of the electrostatic footwear.

Additional objects of the present invention will appear as the description proceeds.

The present invention overcomes the shortcomings of the prior art by providing footwear made from electrostatic cloth providing means for collecting floor resident particulate matter to the footwear when worn by a user.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

LIST OF REFERENCE NUMERALS

Figure 1:
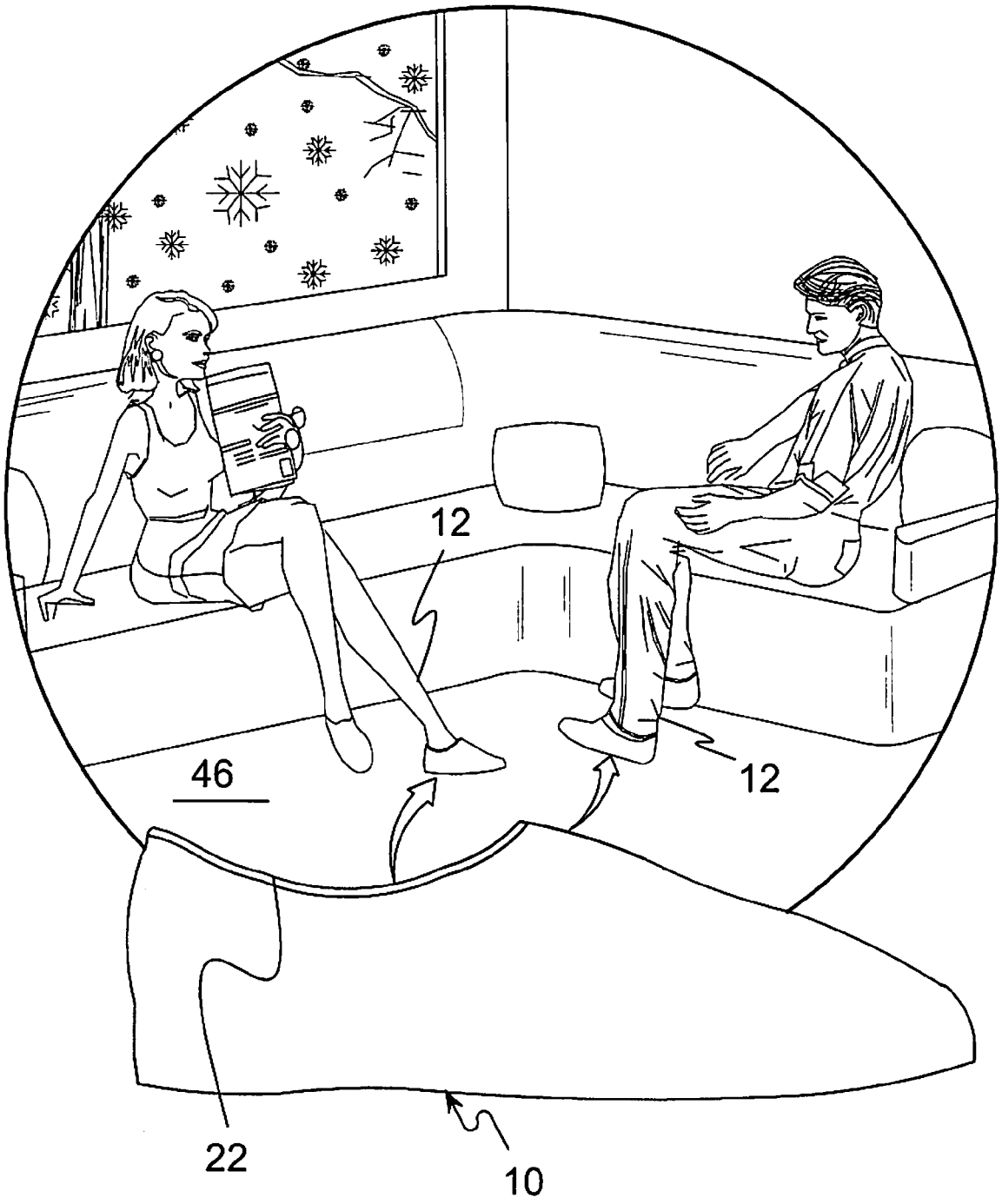
FIG. 1 is an illustrated view of the present invention in use.

With regard to reference numerals used, the following numbering is used throughout the drawings.

10 Cover
12 User
14 Shoe
16 Sole
18 Upper
20 Opening
22 Elastic
24 Cuff
26 Non-woven Fabric
28 Debris
30 Floor
32 Non-Slip Material
34 Negative Charge (–)
36 Positive Charge (+)
38 Barrier Layer
40 Toe
42 Instep
44 Heel
46 Living Room
48 Kitchen

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10A illustrate the cover of the present invention which is indicated generally by the reference numeral 10.

FIG. 1 is an illustrated view of the present invention in use. The present invention is a cover 10 for the foot or shoe 14 of a user 12. The cover 10 may be worn over the feet when a user 12 is not wearing shoes or the cover 10 may be worn over the shoes 14 of the user when a user 12 is wearing shoes 14. The cover 10 is provided with an electrostatic charge and is formed into a slipper-like article having a sole 16 and upper 18. The upper 18 has an opening 20 therein for accepting or receiving the foot or the shoe 14 of the user 12. The opening 20 may be provided with elastic 22 to retain the cover 10 about the shoe 14 or the foot of the user 12. The opening 20 may have a cuff 24 secured thereon for comfort of the user 12 (see FIG. 5A). The cuff 24 may include or be made of elastic material so that the cuff 24 is stretchy and elastic and will hold the cover 10 securely about the user 12. The cover 10 has an excess electrical charge so that when the user 12 places the cover 10 over their shoe 14 or foot and proceeds to walk across a floor 30, debris 28 including dirt, dust, pollen, dander, etc., are electrically drawn to the cover 10 and retained thereon. Additionally, the sole 16 may be provided with non-slip material 32 in limited areas so as not to defeat or eliminate the debris 28 retaining capability of the cover 10. The non-slip material 32 may be applied by spray or any other suitable means.

Figure 2:
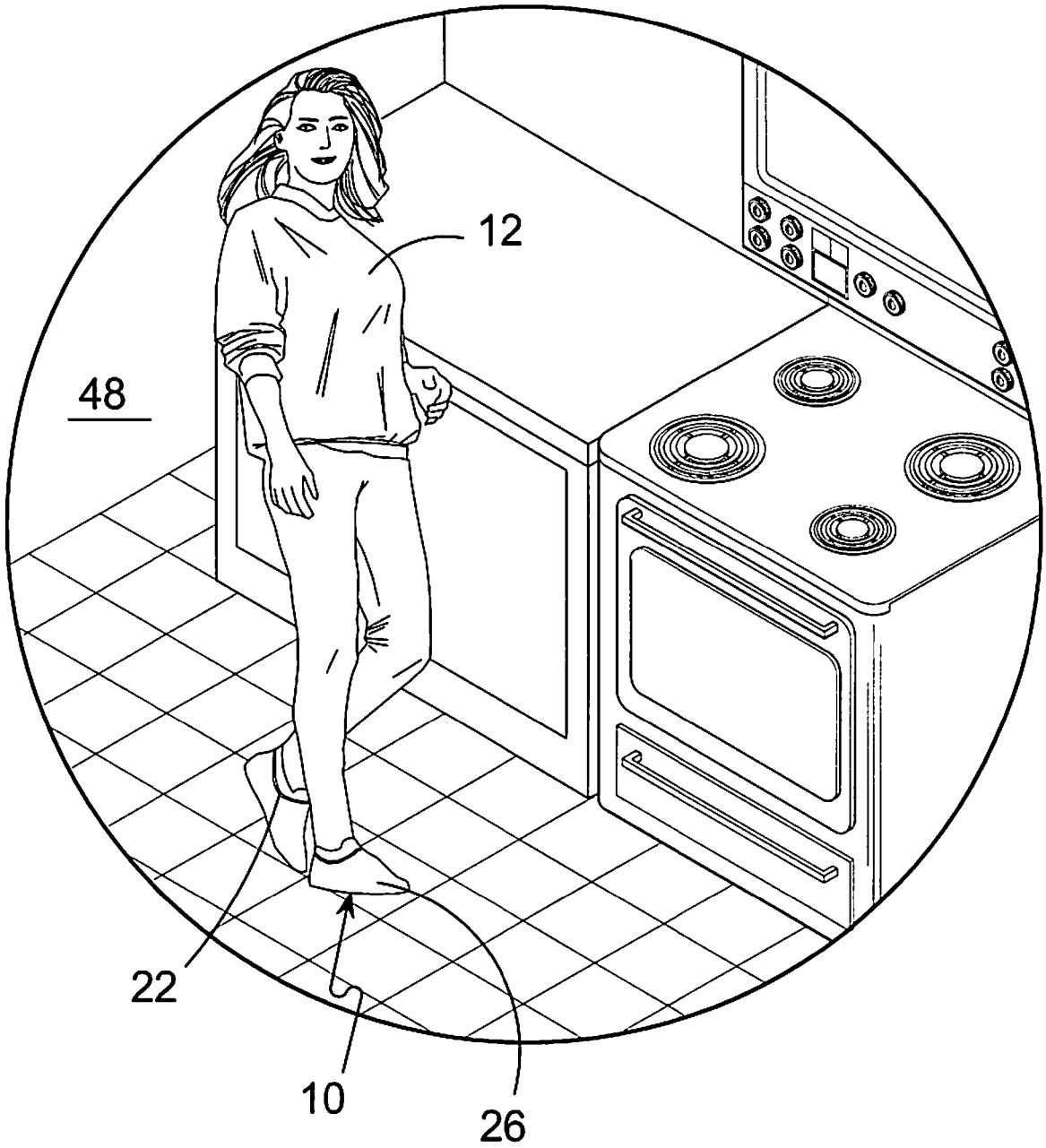
FIG. 2 is an illustrated view of the present invention in use on a smooth surface.
Figure 10:
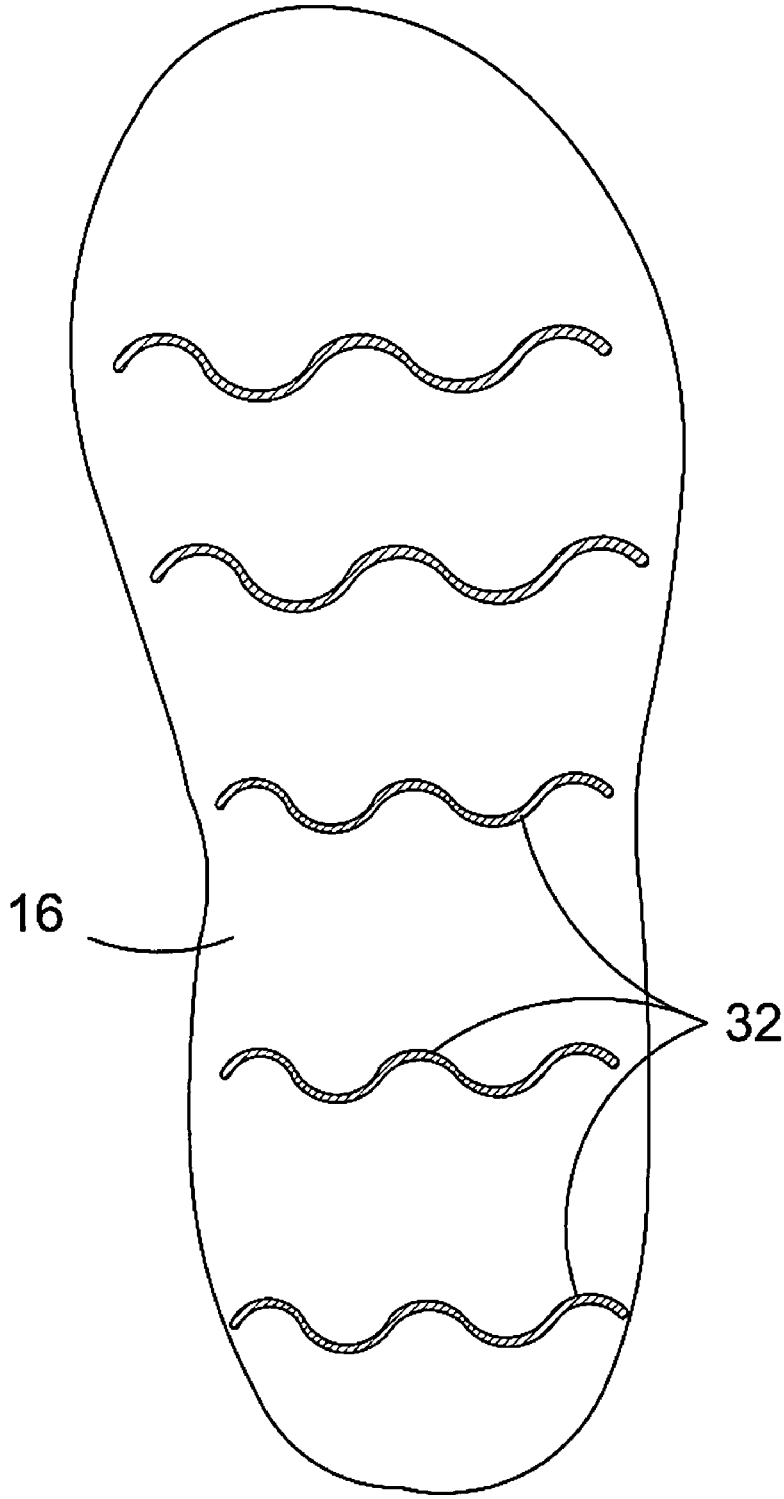
FIG. 10 is a bottom view of the present invention.
Figure 10A:
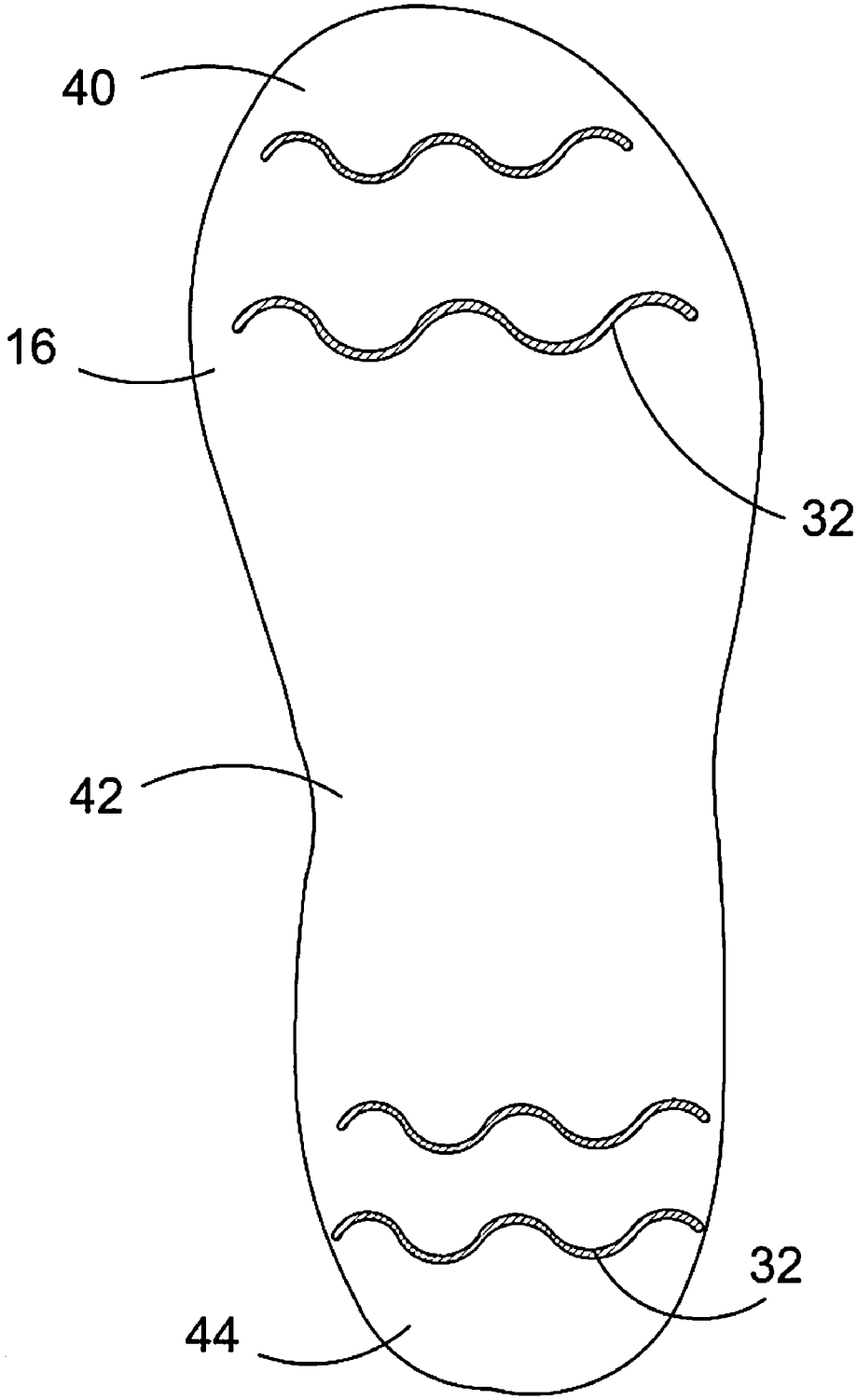
FIG. 10A is a bottom view of an additional aspect of the present invention.

FIG. 2 is an illustrated view of the present invention in use on a surface. The present invention is a disposable cover 10 that is worn indoors over shoes 14 or feet for cleaning dust, hair, dander, dirt, and other debris 28 while the wearer goes about normal daily activities. The cover 10 may be made of a non-woven fabric 26. Elastic 22 is provided at the opening 20 to snugly close the opening 20 around the wearer's foot or ankle. The cover 10 has a sole 16 that extends over the bottom of the users foot or the sole of their shoe 14. The cover 10 also has an upper 18 that for extending over at least a portion of the upper part of the user's 12 foot or the upper of their shoe 14. It is envisioned that the cover 10 may extend over all or only a part of the upper portion of the user's foot or the upper of their shoe 14. The cover 10 may be made of any material with properties that attract and trap dust, dirt, hair, dander, and other debris, but is preferably made of a non-woven fabric 26 or a microfiber which have been provided with an electrostatic charge. The sole 16 may include strips of non-slip material 32 to increase traction (FIGS. 10, 10A). It is envisioned that the cover 10 of the present invention may be employed on any surface such as but not limited to tile, wood, laminate, and vinyl.

Figure 3:
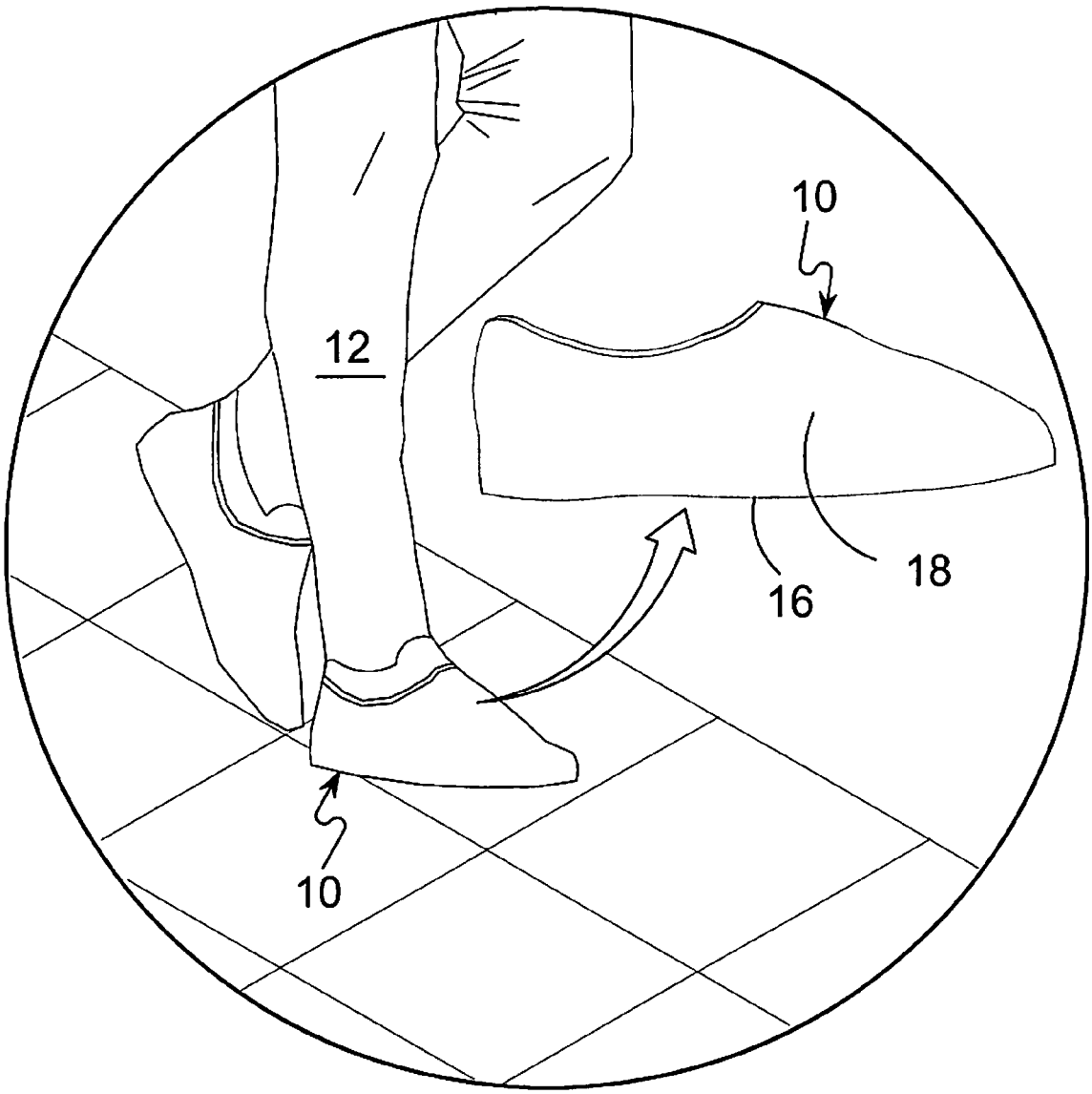
FIG. 3 is an illustrative detailed view of the present invention in use on a smooth surface.

FIG. 3 is an illustrative detailed view of the present invention in use on a surface. The cover 10 extends over only a portion of the user's shoe 14. It is envisioned that the cover 10 may extend over the entire shoe 14 or only a portion thereof. It is also envisioned that the cover 10 may extend over a small portion of the shoe (see FIG. 8A). It is preferred that the cover 10 extends over the sole of the shoe 14 and covers at least a portion of the upper of the shoe 14. This enables the cover to have a secondary function of keeping floors 30, including carpeted surfaces from getting dirty from soiled shoes 14. The disposable cover 10 is worn indoors where cleanliness is desired with the purpose of keeping tile, wood, laminate and vinyl floors free of dust, hair, dander, dirt, and other small debris 28. The cover 10 may be made of a single piece of material such as non-woven polypropylene where the sole 16 and the upper 18 are made of the same material. The sole 16 and the upper 18 may be made of different materials. The upper 18 may be made of a microfiber and the sole 16 may be made of a non-woven fabric 26 such as polypropylene. Making the upper 18 out of microfiber provides the user with a more comfortable cover 10 when employed over bare feet. The upper 18 and the sole 16 may be joined at a seam by stitching, adhesive bonding, thermally bonding, or any other suitable fastening means.

Figure 4:
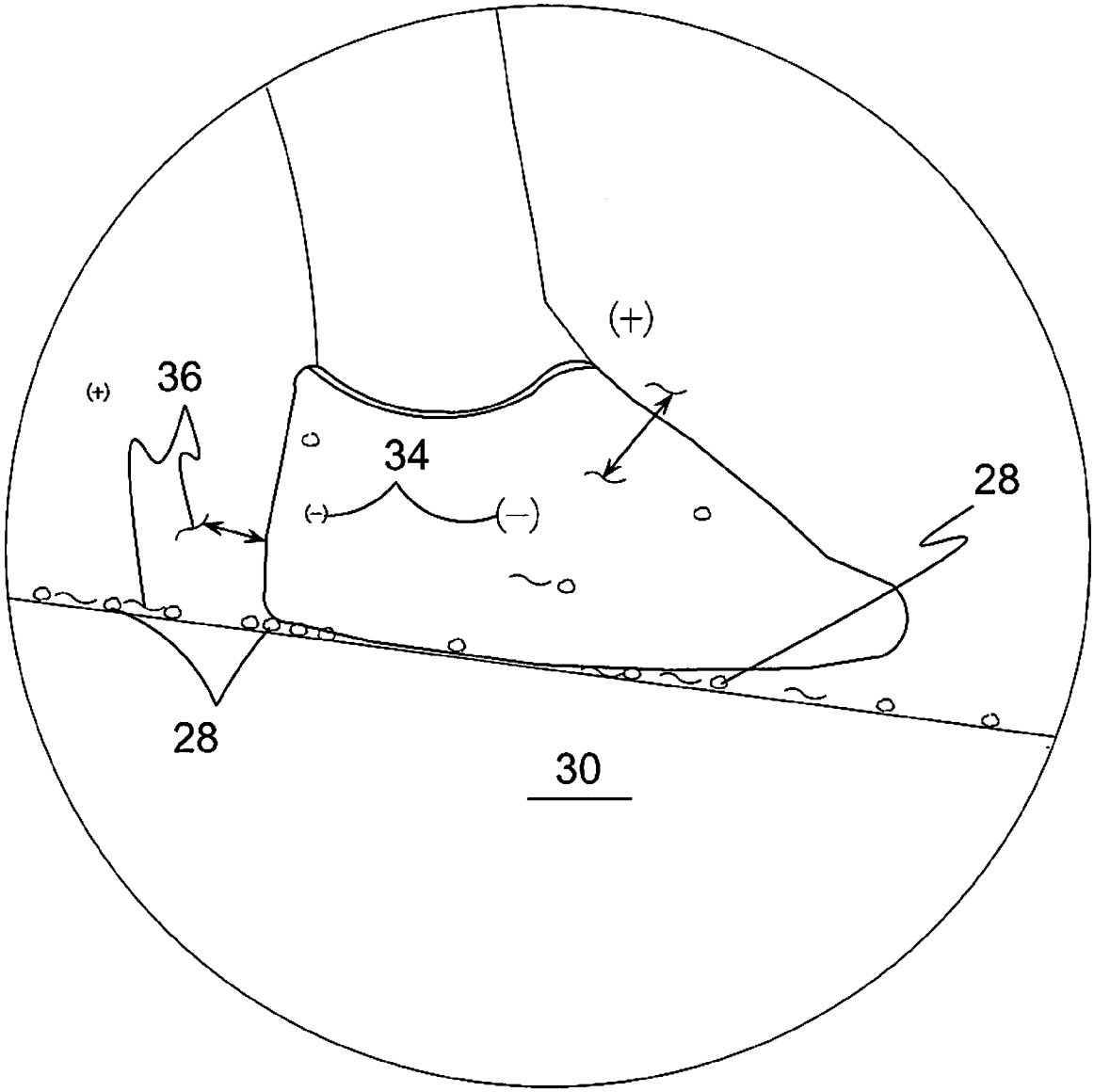
FIG. 4 is an illustrative view of the present invention in use.
Figure 4A:
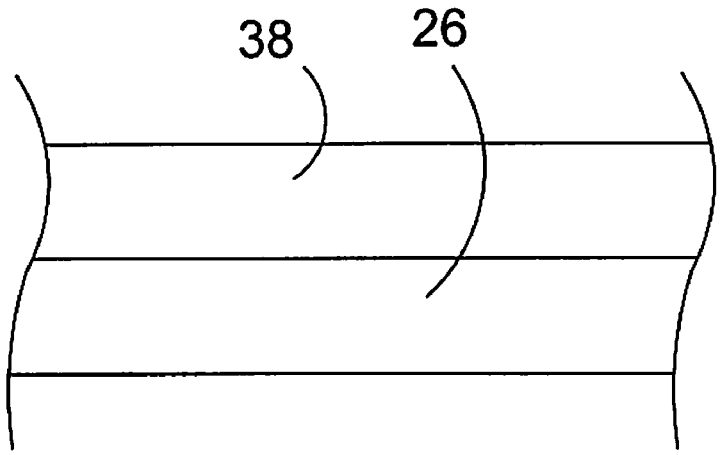
FIG. 4A is a sectional view of additional aspect of the present invention.
Figure 4B:
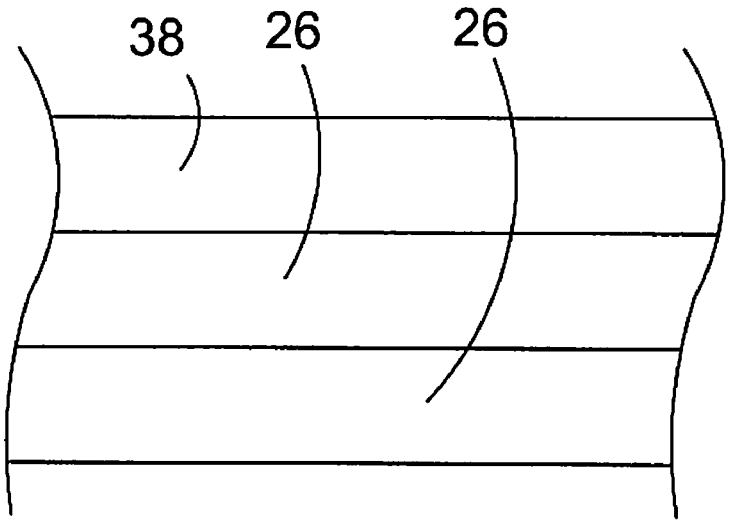
FIG. 4B is a sectional view of additional aspect of the present invention.

FIG. 4 is an illustrative view of the present invention in use. This figure illustrates how the electrostatic charge in the material of the cover 10 functions to attract debris 28 such as but not limited to pollen, dander, dust, hair, and dirt. The cover 10 may be provided with a negative charge 34 as seen in the Figure to attract debris 28 that is positively charged 36. It is envisioned that the cover 10 may be positively charged to attract negatively charged debris 28. The cover 10 may also function to prevent dirt and debris 28 on soiled shoes from getting on carpet and other floor 30 surfaces. The cover 10 may be provided with an additional layer on its inner surface to prevent debris 28 that is wet from passing through the cover 10 and soiling carpet and other flooring. The cover 10 may be provided with a barrier layer 38 of waterproof plastic such as polyethylene, polypropylene, or other suitable waterproof plastic (FIG. 4A). The barrier layer 28 may be in the form of a sheet. The sheet would preferably be laminated to the material of the cover 10 prior to forming the cover 10. The cover 10 may employ one or more non-woven layers as seen in FIGS. 4A and 4B. It is envisioned that multiple layers of non-woven fabric 26 would be laminated together by heat or adhesive or a combination thereof.

Figure 5:
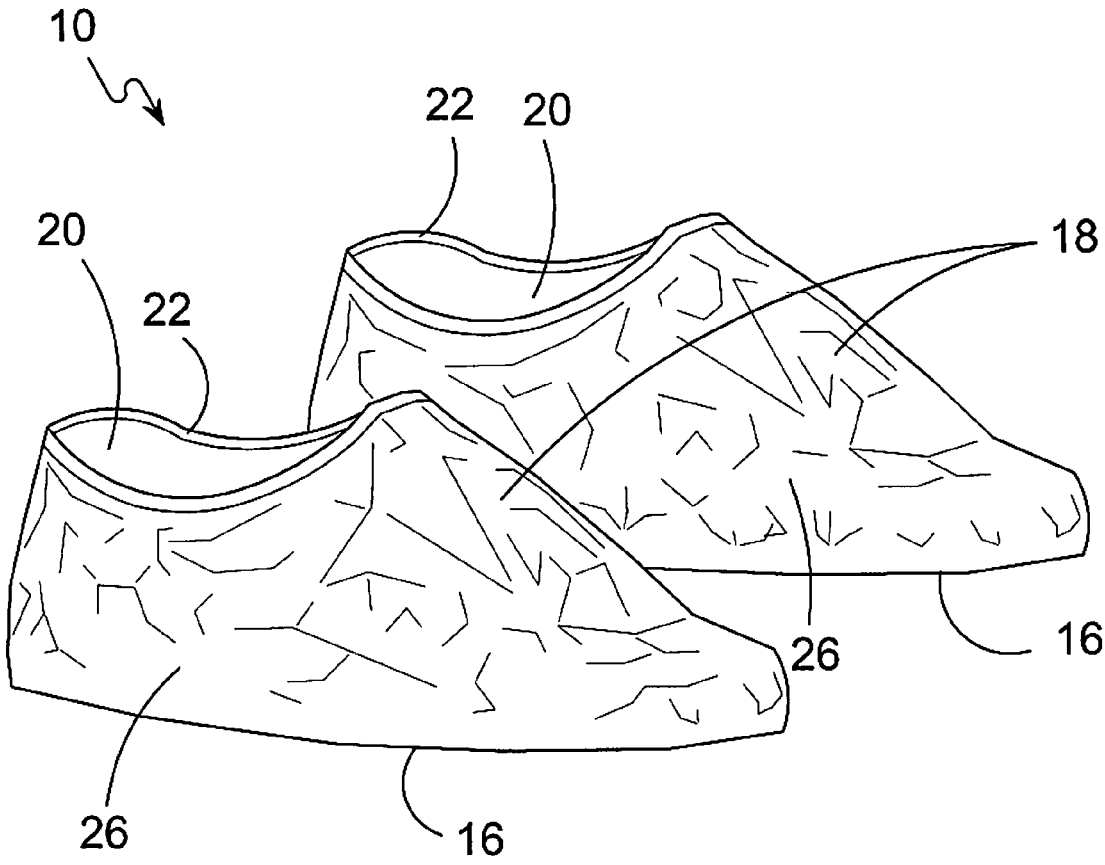
FIG. 5 is a perspective view of the present invention.
Figure 5A:
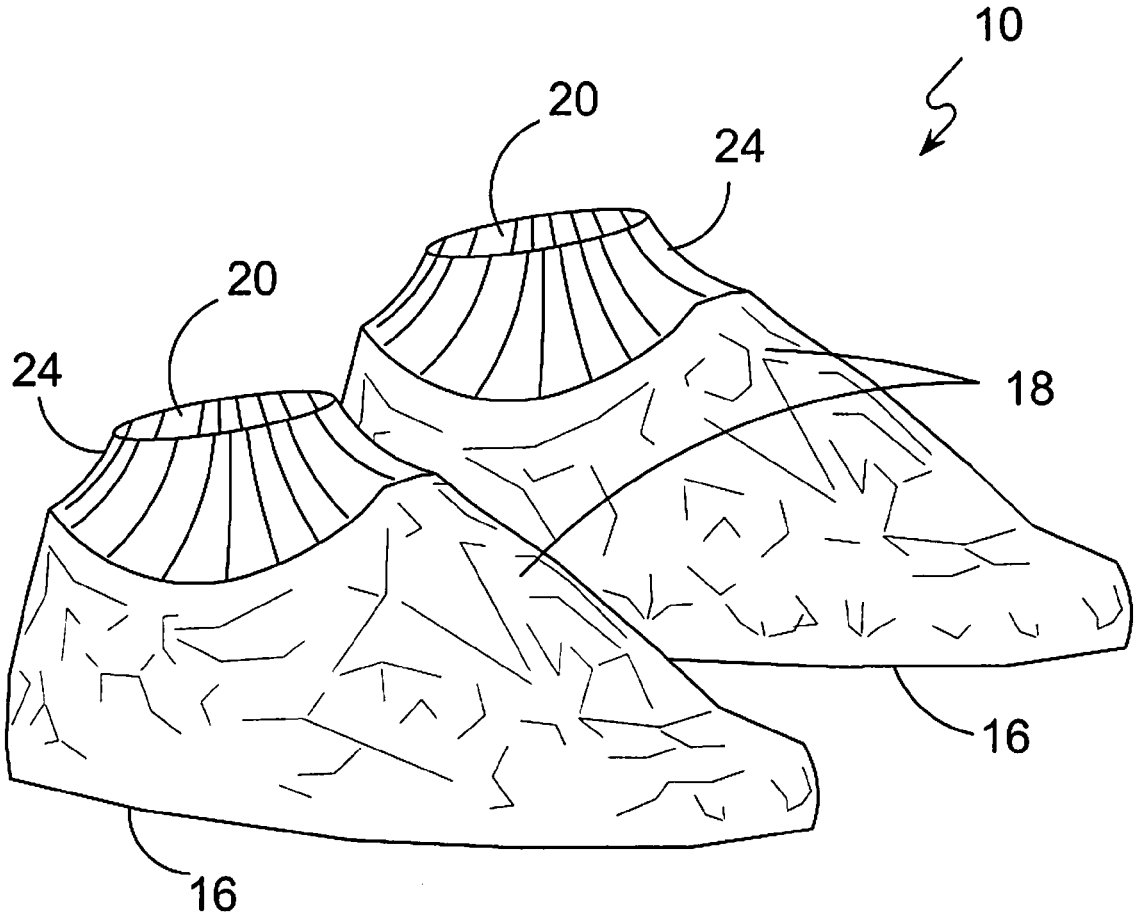
FIG. 5A is a perspective view of an additional aspect of the present invention.

FIG. 5 is a perspective view of the present invention. Shown is a pair of covers 10 that are worn over the feet or shoes 14 of a user 12. They are particularly useful for pet owners and allergy sufferers. The cover 10 may be made of a non-woven fabric 26 such as but not limited to a spunbound polypropylene. The material of the cover 10 is provided with an electrostatic charge to attract dander, hair, pollen, dirt, and other debris 28.

Figure 6:
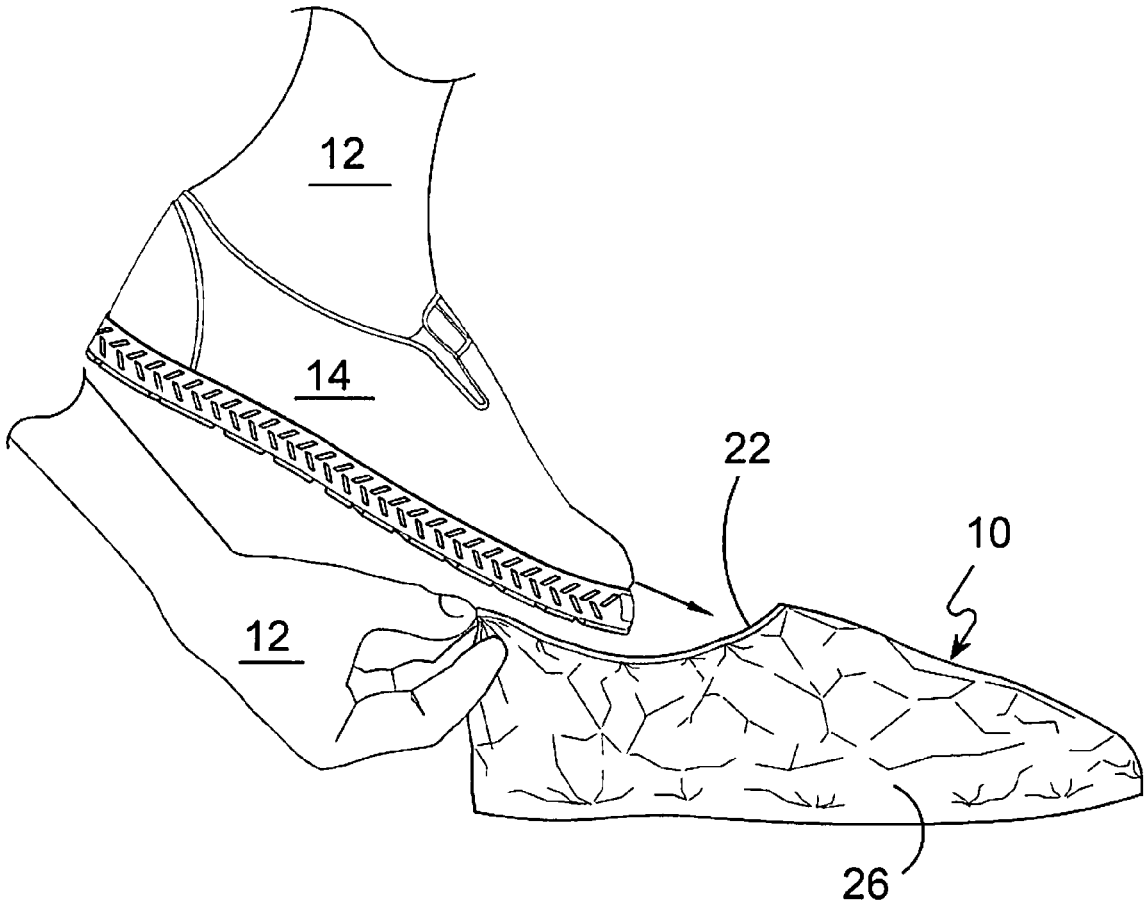
FIG. 6 is a side view of the present invention about to be used.
Figure 7:
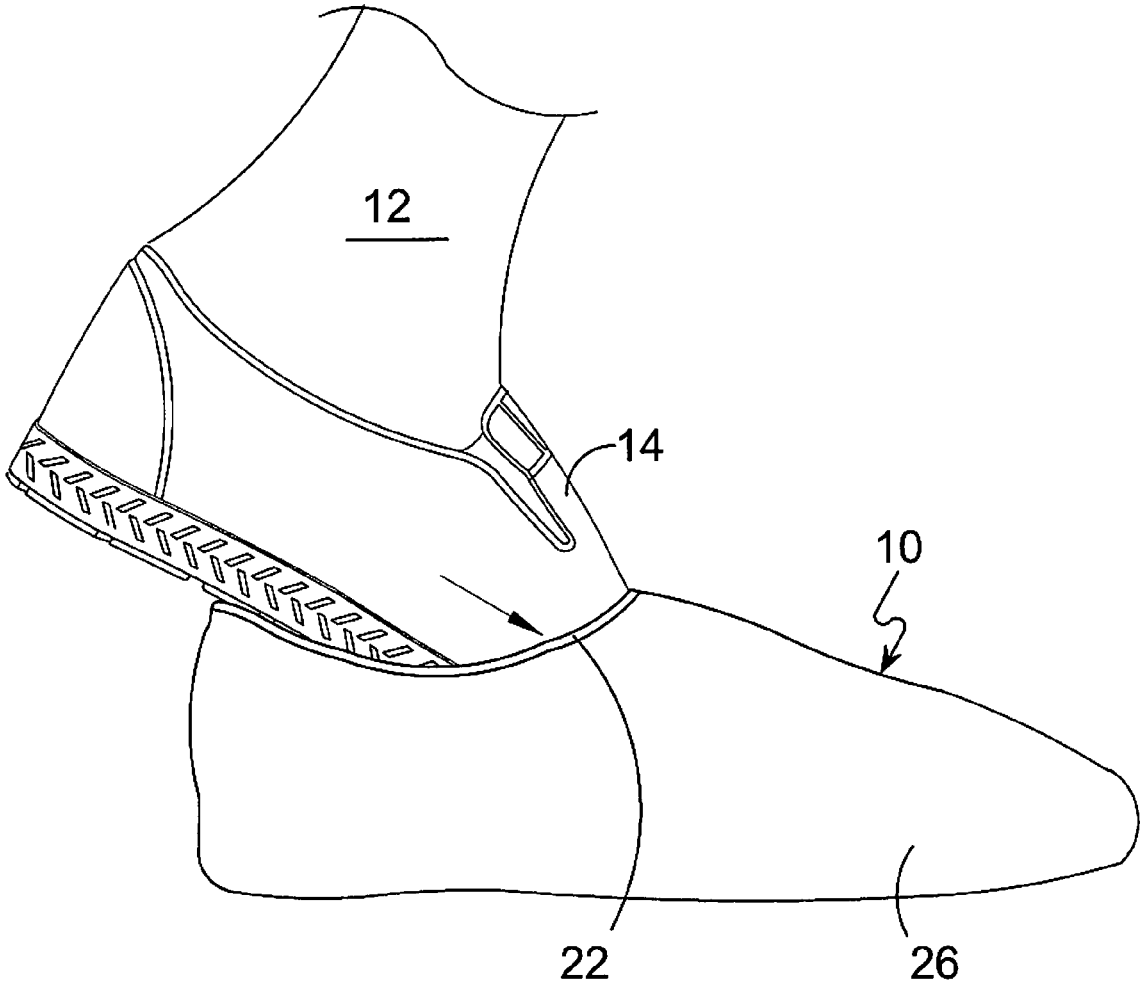
FIG. 7 is a side view of the present invention with wearer's shoe partially within.
Figure 8:
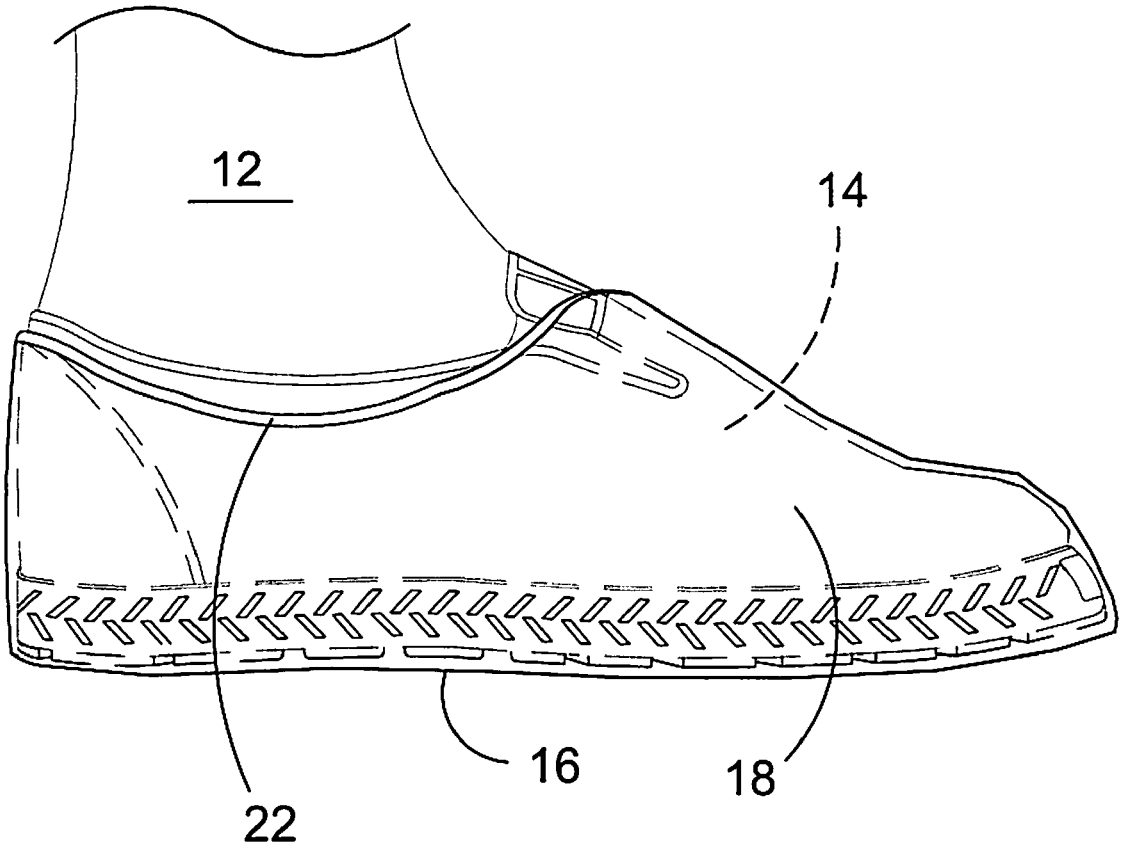
FIG. 8 is a side view of the present invention with wearer's shoe fully within the shoe cover.
Figure 8A:
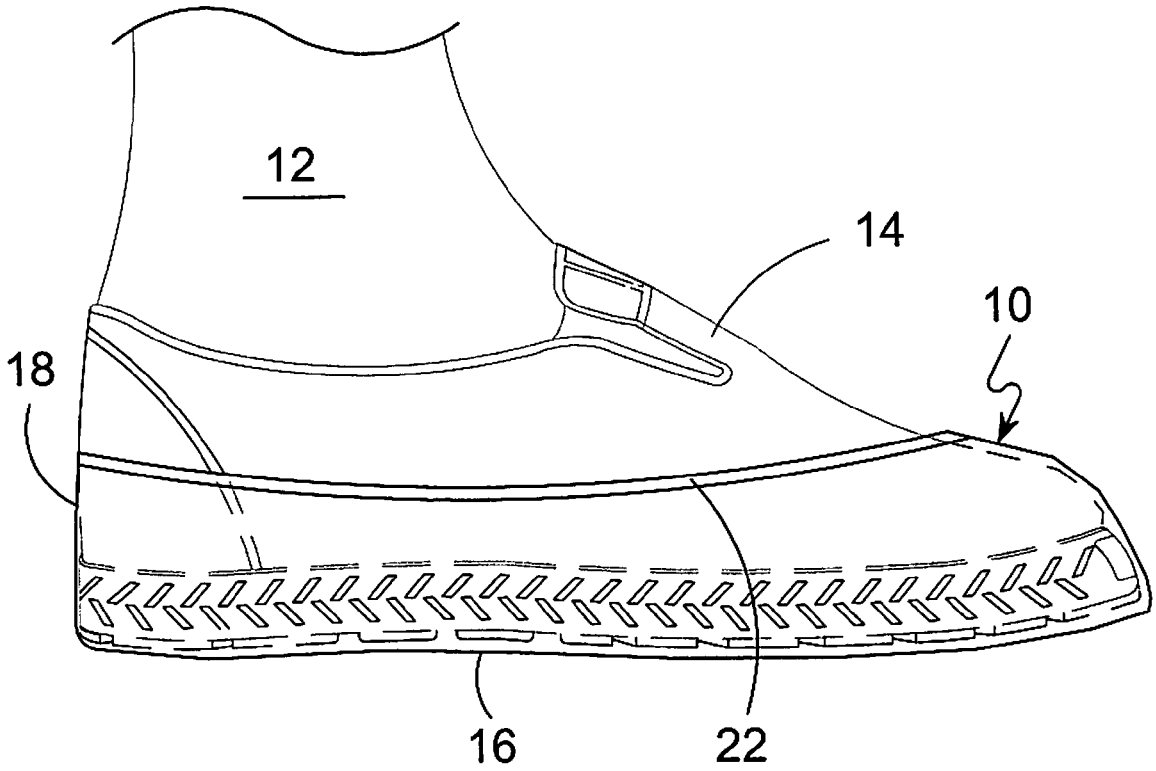
FIG. 8A is a side view of an additional aspect of the present invention.

FIGS. 6-8 are illustrative side views of the present invention. The three figures show how a cover 10 may be placed over the shoe 14 of the user 12. The user 12 may grasp the cover 10 and direct the toe of their shoe 14 into the opening 20 (FIG. 6). The opening 20 in the cover 10 is provided with elastic 22 so that it may stretch and expand to receive the shoe 14. Once the cover 10 has reached a certain point (FIG. 7), the user 12 may grasp the opening 20 with both hands to enlarge it to allow the shoe 14 to pass easily there through. Once the cover 10 has been pulled over the shoe 14 (FIG. 8), the elastic 22 in the opening closes snugly around the shoe 14 and foot of the user 12.

Figure 9:
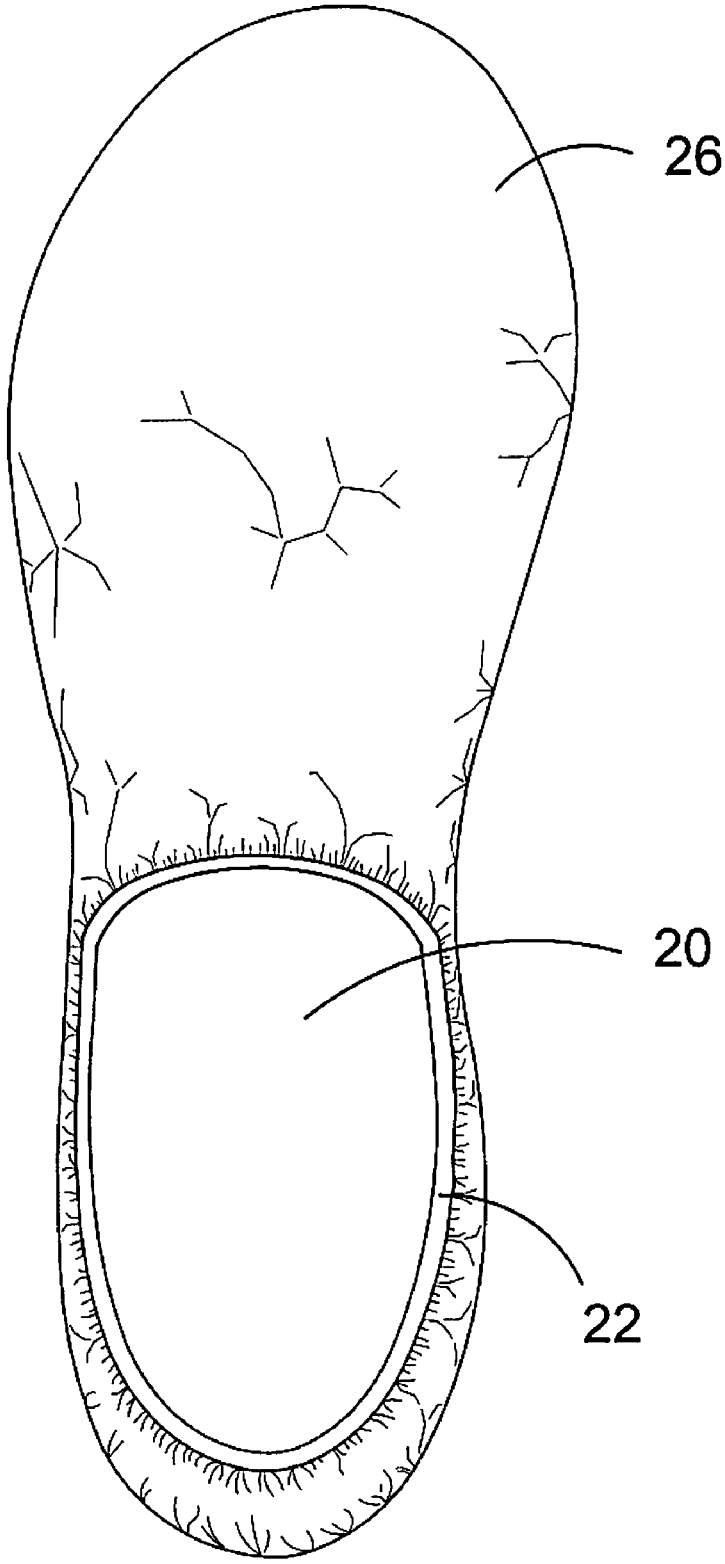
FIG. 9 is a top view of the present invention.

FIG. 9 is a top view of the present invention. This view gives a detailed view of the opening 20 in the cover 10. The elastic 22 secured to the opening 20 causes the opening 20 to look wrinkled. This is typically known as gathering. The gathering allows the opening 20 to expand without tearing the material of the cover 10. This is achieved by securing the elastic 22 to the opening 20 after it has been stretched or elongated. After the elastic 22 has been secured, it is allowed to return to its un-stretched state, and the material around the opening 20 gathers and folds on itself causing the wrinkled look. It is envisioned that the material or the fabric forming the cover 10 may be a stretch fabric that has an elastic material in the fabric to make the fabric stretch and enlarge and then return to its original size and shape. This will provide a more snug and secure fit about the feet or shoes 14 of a user 12.

FIG. 10 is a bottom view of the present invention. Shown is exterior surface of the sole 16 of the cover 10. This is the surface of the sole 16 that comes in contact with the floor 30. The exterior surface of the sole 16 may be provided with strips of non-slip material 32. The non-slip material 32 may cover the central part of the sole 16 commonly referred to as the instep 42. It preferred that the central or instep 42 portion of the sole 16 be free of non-slip material 32 (see FIG. 10A). The non-slip material 32 is preferably limited to the toe 40 and heel 44 portions of the sole 16. This leaves the central or instep 42 portion free of non-slip material 32 and provides a large unobstructed area for the collection of debris 28. The non-slip material 32 may be a resilient or elastic material such as but not limited to natural rubber, synthetic rubber, elastomers, or other materials that are capable of providing sufficient traction for the user 12. The non-slip material 32 may be applied by spraying or any other suitable application method. The non-slip material 32 may be applied in any pattern so long as it does not diminish the ability of the cover 10 to collect and retain debris.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A cover for a shoe or a foot of a user, the cover comprising:

a sole joined to an upper portion, the upper portion having an opening that is capable of receiving the shoe or the foot of the user, wherein both the sole and upper portions are provided with an electrostatic charge to attract and retain particulate matter of the type consisting of lint, dust, hair, and small debris, said cover not having a scrubbing layer; and said sole having non-slip material in areas limited so as not to defeat particulate matter retaining capability of said cover.

2. The cover of claim 1, wherein the sole is made of material selected from the group consisting of non-woven fabric, woven fabric, and microfiber.

3. The cover of claim 2, wherein the upper portion is made of material selected from the group consisting of non-woven fabric, woven fabric, and microfiber.

4. The cover of claim 1, wherein only toe and heel portions of the sole have anti slip material.

5. The cover of claim 4, wherein the opening in the upper member has an elastic member secured thereon for retaining the cover about the foot or shoe of the user.

6. The cover of claim 5, wherein the cover is made from non-woven polypropylene.

7. The cover of claim 5, wherein the cover is made from microfiber.

8. The cover of claim 6, wherein the polypropylene is a composition that contains between 5 and 25 percent polyimide.

9. The cover of claim 8, wherein said cover has an inside barrier layer of waterproof plastic.

10. A method of reducing the amount of airborne particles in an enclosed area that can irritate allergies comprising the steps of:

making a cover for a shoe or a foot of a user, the cover comprising a sole joined to an upper portion, the upper portion having an opening for receiving the shoe or the foot of the user, said cover being provided with an electrostatic charge capable of attracting and retaining particulate matter of the type consisting of lint, dust, hair, and small debris, said cover being made of non-woven porous materials selected from the group consisting of spunbound polypropylene and laminates, said cover lacking any scrubbing layer;

applying to the sole of said cover non-slip material only in heel and toe areas so as not to defeat particulate retaining capability of said cover; and a user wearing said cover in said enclosed area while going about non-cleaning related activities without taking extra time to maintain a floor free of said particulate matter.

11. A cover for, and in combination with, a shoe of a user, consisting of:

the cover having a sole joined to an upper portion, the upper portion having an opening for receiving said shoe, wherein both the sole and upper portion are provided with an electrostatic charge to attract and retain particulate matter of the type attracted to said electrostatic charge, said cover not having a scrubbing layer;

said sole having non-slip material in areas limited to heel and toe surfaces so as not to defeat particulate matter retaining capability of said cover; and a barrier layer of waterproof material lining an inner surface of said cover to prevent dirt and debris on said shoes from soiling carpet and other floor surfaces.

12. The cover of claim 11 in which said electrostatic charge is a positive charge.

13. The cover of claim 11 in which said electrostatic charge is a negative charge.

* * * * *